United States Patent [19]

Suchy

[11] Patent Number: 4,654,291

[45] Date of Patent: Mar. 31, 1987

[54] EMULSION POLYMERIZATION OF METHACRYLONITRILE AS VEHICLE FOR VESICULAR PHOTOGRAPHY AND METHOD OF MAKING AND USING SAME

[75] Inventor: Jan B. Suchy, Hampden, Mass.

[73] Assignee: James River Graphics, South Hadley, Mass.

[21] Appl. No.: 800,109

[22] Filed: Nov. 22, 1985

Related U.S. Application Data

[63] Continuation of Ser. No. 474,056, Mar. 10, 1983, abandoned.

[51] Int. Cl.[4] ..... G03C 1/52; G03C 1/60

[52] U.S. Cl. ..... 430/170; 430/152; 430/176; 430/192; 430/197; 430/270; 430/290

[58] Field of Search ..... 430/152, 176, 197, 192, 430/290, 170, 270

[56] References Cited

U.S. PATENT DOCUMENTS

| | | | |
|---|---|---|---|
| 3,457,071 | 7/1969 | Notley et al. | 430/152 |
| 3,622,333 | 11/1971 | Cope | 430/152 |
| 3,622,335 | 11/1971 | Notley | 430/152 |
| 3,622,336 | 11/1971 | Notley | 430/152 |
| 3,661,589 | 5/1972 | Notley | 430/152 |
| 3,708,296 | 1/1973 | Schlesinger | 430/176 |
| 3,765,894 | 10/1973 | Mellan | 430/274 |
| 4,215,191 | 7/1980 | Kwok | 430/197 |
| 4,219,616 | 8/1980 | Pope et al. | 430/152 |
| 4,272,603 | 6/1981 | Chenevert et al. | 430/152 |
| 4,273,851 | 6/1981 | Muzyczko et al. | 430/197 |

*Primary Examiner*—Charles L. Bowers, Jr.

*Attorney, Agent, or Firm*—Burns, Doane, Swecker & Mathis

[57] ABSTRACT

An improved vesicular matrix prepared by employing regulated inner incompatibility to produce enhanced nucleation. The inner incompatibility is produced by copolymerizing a first monomer with a small amount of a second monomer wherein a homopolymer of the second monomer would be incompatible with a polymer of the first monomer, or by blending a first polymer or copolymer with a small amount of a highly incompatible second polymer or copolymer.

1 Claim, No Drawings

EMULSION POLYMERIZATION OF METHACRYLONITRILE AS VEHICLE FOR VESICULAR PHOTOGRAPHY AND METHOD OF MAKING AND USING SAME

This application is a continuation of application Ser. No. 474,056 filed Nov. 10, 1983 abandoned.

BACKGROUND OF THE INVENTION

1. Field of the Invention

The present invention relates to vesicular photography, and more particularly, to improved vesicular matrices for use in vesicular photography, and novel copolymers for use therein.

2. Description of the Prior Art

Diazo type photoreproduction is of two different types. Each is based on the light sensitivity of aromatic diazonium salts, and the fact that such salts undergo decomposition by light can be used in two ways: (1) decomposition, in which nitrogen evolves as gas in exposed areas; and (2) "coupling", wherein the diazonium compound retained in not exposed areas reacts with certain couplable color-forming components, i.e., a "coupler" or "azo-coupling component", to effect formation of an azo dye species.

The present invention is concerned with the former type of reaction, that is, the vesicular process. Vesicular images are formed in a photographic film by small bubbles or vesicles of gas which are formed and trapped in the areas of the film exposed to light and which scatter light. Vesicular film has a colloid or a resin coating or vehicle on a backing material and a light sensitive agent or sensitizer, such as a diazonium compound, dispersed throughout the coating. When the film is exposed to light, the sensitizer releases molecules of a gas. In the case of diazonium compounds, the gas is nitrogen. Rather than forming vesicles immediately, the vesicles are formed when the film is heated, presumably because the vehicle is relaxed sufficiently on heating for the gas molecules to form bubbles, and for the bubbles to expand. The formation of the vesicles makes the vehicle opaque to transmission of light in the exposed areas, and the vesicles also reflect and scatter light so that they appear white.

Preservation of the image depends upon the vehicle maintaining its rigidity and the vesicles being fixed in place. Although the rigidity of the vehicle is reduced during development to permit formation of vesicles and to allow the vesicles to expand, the rigidity is restored by cooling to give permanency to the image after development. For permanency, the vehicle must remain rigid under the heat and moisture conditions to which it will be exposed.

The first vesicular materials employed gelatin as the vehicle. However, such images faded rapidly because of the sensitivity of gelatin to water. Gelatin vehicles absorbed moisture from the atmosphere and became soft, allowing the vesicle to collapse, thereby destroying the image.

Numerous patents describe later attempts at developing suitable matrices. Although numerous such matrices have been developed, only three systems are currently being employed commercially; those being systems based on saran, polyhydroxyether, and poly-alpha-chloroacrylonitrile.

One material which appeared promising but has never been commercialized is polymethacrylonitrile.

Despite a suitable softening point and a suitably low diffusion constant for nitrogen, its potential has yet to be realized.

The basic patent concerning polymethacrylonitrile is U.S. Pat. No. 3,161,511 to Parker and Mokler which describes a vehicle manufactured using polymethacrylonitrile as the resin matrix. As stated in that patent, homopolymers are preferable to copolymers because they are easier to manufacture.

The difficulty in the manufacture of copolymers is controlling proportions when there are two or more monomers. Monomers typically do not polymerize at the same rate, i.e. if two monomers are polymerized together, one will enter into the reaction more easily than the other. As the reaction proceeds, the more reactive monomer will be consumed more rapidly, and the relative proportions of the two monomers will change. Since the rate at which the monomers enter into the reaction depends on their relative proportions as well as their inherent activity toward the reaction, their reaction rates change. As the reaction proceeds, the relative proportion of the monomers entering the growing polymer changes, and the polymer produced at the beginning of the reaction has different monomer proportions from the polymer produced later.

To avoid this result, at least in part, monomer is sometimes continuously added during the reaction to maintain constant proportions. Another possibility is to accept variations in the proportions of the monomers in the polymer and to later thoroughly blend the resulting polymers to assure uniform properties throughout each batch. The average properties then meet the needs of the product. However, this may result in variations from batch to batch because of variations in the completeness of the reaction or other conditions.

U.S. Pat. Nos. 3,622,335 and 3,622,336 to Notley are improvements on the Parker and Mokler patent mentioned above. These patents represent attempts to produce copolymers in spite of the problems discussed in the Parker and Mokler patent. The '335 patent employs copolymers of alpha substituted acrylonitrile (which includes methacrylonitrile) and a styrene-type monomer. It is stated therein that the proportion of comonomer must exceed 5 mole percent and it is not generally desired to exceed 60 mole percent or the desired characteristics of the substituted acrylonitrile will be significantly reduced. Furthermore, it is stated that any two copolymers produced therein can be blended where they are compatible in a common solvent or mixed solvent, and that the essential polymer can be blended with limited amounts of a non-essential but compatible polymer such as cellulose acetate, cellulose acetate butyrate, polyalphamethylstyrene, polyvinylidene chloride, acrylonitrile copolymer and polymethylmethacrylate.

The '336 patent is similar to the '335 patent except that it describes a copolymer of alpha-chloroacrylonitrile and alpha-methacrylonitrile. The ratio of the monomers is stated to be between 1:4 and 4:1, and a preferred ratio is stated to be 1:2.

U.S. Pat. No. 3,661,589 to Notley describes a different approach. Rather than copolymerization, a vesicular imaging film was formed by mutually dispersing two resin solutions at the threshold of compatibility but having a common or mutual solvent, each of the resin solutions containing a sensitizer which liberates gas on irradiation, coating the resulting dispersion as a thin film, and then drying. The resulting thermoplastic film is stated to be an intimate dispersion of one hydrophobic resin in the other hydrophobic resin with the sensitizer dispersed throughout.

The Notley '589 patent also sets forth the criteria that a hydrophobic resin used in vesicular photography must satisfy, and reiterates that these criteria are very comprehensive and quite critical. These include very low permeability, good rigidity under ambient conditions, a convenient softening temperature at which the polymer is sufficiently fluid to permit vesicles to form but at which the gas permeability is still not excessively high, good solubility, good film forming characteristics, good adhesion to inert substrates and good binding for high concentrations of sensitizer.

In the structure described in the Notley '589 patent, hydrophobic resin is encapsulated within a continuous coating of another hydrophobic resin, with the light sensitive gas generating material dispersed throughout the encapsulate and the encapsulating resin. The optimum amount of encapsulated resin is stated to exceed 5% but generally not to exceed 50% of the total resin. The threshold incompatibility described therein is illustrated by mixing two parts of a 20% solution of polystyrene in butanone with one part of a 20% solution of a polyvinylidene chloride/acrylonitrile copolymer in the same solvent. By using polystyrene to saran in a ratio between 1 to 1 and 1 to 6, the solution is only slightly hazy and good coating quality is said to be achieved from the agitated solution. The threshold incompatibility is seen when the dispersion is allowed to stand since it separated into two layers, one rich in polystyrene and the other in saran. Preferred encapsulating resins therein are saran, polyvinylacetals, copolymers of methacrylonitrile, and chloroacrylonitrile homopolymer and copolymers. The choice of encapsulated resin is based on the diffusion coefficient and the refractive index. Encapsulating/encapsulated resin combinations listed include saran with polystyrene, ortho/para polychlorostyrene or cellulose acetate; formaldehyde polyvinyl acetal with polystyrene or cellulose acetate; formaldehyde polyvinyl acetal with polystyrene or polyketone; methacrylonitrile-methylmethacrylate copolymer with saran or cellulose acetate; and chloroacrylonitrile-styrene copolymer with polystyrene.

While polymethacrylonitrile has a suitable softening point (Tg=120° C.) which should supply good developing and good thermal stability of vesicles, and has a diffusion coefficient for nitrogen which is also very low (approximately $5\times10^{-13}$) which should prevent nitrogen from escaping prior to the development of the film, the technology described by the above patents is not currently being used commercially. Such compositions are slow in comparison to presently marketed films, with the problem appearing to be related to insufficient nucleation, possibly because of high lattice homogeneity of the polymer. For example, in comparison to a similar polymer (poly-alpha-chloroacrylonitrile), a polymethacrylonitrile film is much slower.

Accordingly, a need exists for a vesicular vehicle having the desirable properties of polymethacrylonitrile with a speed comparable to those of commercially available materials.

SUMMARY OF THE INVENTION

The present invention is based upon the discovery that regulated inner incompatibility can be used to produce enhanced nucleation in a vesicular matrix. Regulated inner incompatibility can be produced by copolymerizing a first monomer with a small amount of a second monomer in the presence of an anionic or nonionic emulsifier to produce a novel copolymer. The first monomer, which will typically be present at 95 wt. % or greater, is chosen to result in a copolymer having the physical properties needed to serve as a vesicular matrix, whereas the second monomer is one which would form a homopolymer which would be incompatible with a polymer of the first monomer. By choosing a combination of monomers having a large difference in reactivity, copolymer is produced wherein the relative proportion of the second monomer incorporated will vary over the course of the polymerization. The small amount of second monomer incorporated into the copolymer supplies domains of incompatibility which serve as nucleation centers when the copolymer is used as a vesicular matrix.

A similar result can be obtained by blending a small amount of a second polymer with the remainder of the blend being a first polymer which is incompatible with the second polymer.

In both cases, the resin contains less than 5% by weight of the second monomer or second polymer since it is important to produce only a limited number of relatively large nucleation centers.

A particularly preferred first and second monomer combination is methacrylonitrile and vinyl acetate, whereas a particularly preferred polymer combination is polymethacrylonitrile as the first polymer and polyvinyl acetate as the second polymer.

While the blends are discussed above as mixtures of polymers, either one or both of the polymers may be a copolymer, provided that the overall amount of the portion of the polymer or copolymer supplying the inner incompatibility must not exceed 5 wt. %.

It is preferred to include a surfactant in small amounts to further enhance the speed of the film. However, the surfactant should also be used in relatively small amounts since increased surfactant concentrations are not beneficial, and in fact, may reduce the speed of the film.

Finally, the present invention includes an appropriate sensitizer, solvent, and an appropriate support for the matrix.

DETAILED DESCRIPTION OF THE INVENTION

By the present invention, it has been found in one embodiment that superior vesicular matrices can be formed by utilizing a novel copolymer of two monomers produced by emulsion polymerization using an anionic or nonionic emulsifier. The resulting copolymer contains a small amount, typically less than 5% by weight, of the second monomer whose homopolymer would be incompatible with a polymer of the first monomer. The copolymer ultimately produced contains a controlled number of sites where the incompatibility exists.

A preferred copolymer of the present invention is produced by emulsion polymerization of methacrylonitrile with vinyl acetate using an anionic or nonionic emulsifier. Homopolymers of these two resins are highly incompatible, and the reactivity of the monomers is very different (a reactivity ratio of 12:0.01), so that at the beginning of a batch polymerization, very little of the vinyl acetate is incorporated into the copolymer. This amount gradually increases, especially toward the end of the polymerization when practically all the methacrylonitrile becomes exhausted. At that time, the reaction rate drops considerably, even through some vinyl acetate is still left. When the monomer ratio of methacrylonitrile:vinyl acetate is between about 10:1 and about 50:1, only about one fifth to one half, (i.e. between about 0.5 and about 5 wt. %) of the vinyl acetate is built into the copolymer.

Due to the gradually increasing vinyl acetate content during the polymerization, the compatibility of the resulting copolymer gradually drops and the properties of the resulting copolymer can be regulated by the ratio of monomers or by the reaction time. It is preferred that the acetate content in the copolymer be between about 1.0 and about 1.5 wt. % and that the viscometric molecular weight ($M_v$) of the copolymer be between about 100,000 and about 150,000. Such a copolymer supplies a water clear solution in acetone.

When using a methacrylonitrile/vinyl acetate copolymer, it is preferred that the molecular weight and vinyl acetate content of the various batches used to make the film vary as little as possible from the overall average of the batches, since such films exhibit higher speeds and higher thermal resistance than films made from batches with a large variation. However, it is also possible to blend several batches wherein the batches vary widely in $M_v$ and vinyl acetate content to produce an overall average of molecular weight and vinyl acetate content within the desired range. For example, the $M_v$ of the individual batches can vary over as wide a range as from about 30,000 to about 220,000 and the vinyl acetate content can vary over as wide a range as from almost 0 to about 2.3%. When using a blend of copolymers from several batches, the optimum level of loading is to some extent dependent on the molecular weight of the polymethacrylonitrile copolymer. Lower molecular weight polymethacrylonitrile copolymer ($M_v$ below 40,000) requires higher loads and supplies films which are more sensitive to humidity. In contrast, increasing the molecular weight slowly decreases the speed and thermal stability of the film. Above an $M_v$ of about 500,000, the films are very slow and the solubility of the copolymer in common solvents decreases rapidly. Accordingly, the optimal $M_v$ for the polymethacrylonitrile copolymer in such a blend is between about 50,000 and about 300,000, and preferably between about 100,000 and about 200,000.

The methacrylonitrile polymers and copolymers of the present invention are prepared by emulsion polymerization using an anionic or nonionic emulsifier, a technique which is well known in the prior art for preparing polymers and copolymers. Any of the anionic and nonionic emulsifiers known in the prior art can be used in the present invention, a preferred emulsifier being sodium lauryl sulfate. Due to ease of use in preparing polymers and copolymers, anionic emulsifiers are preferred. Other emulsifiers which can be used to advantage include GAFAC 610 (trademark of GAF Corp. for a complex organic phosphate ester); DOWFAX XD-30237 and DOWFAX XD-8390 (trademarks of Dow Chemical Co. for a bis phenyl ether sodium sulfonate substituted by alkyl on one of the phenyl groups, the alkyl chain being branched $C_{12}$ in the case of XD-30237, and linear $C_{16}$ in the case of XD-8390); and LODYNE S103 (trademark of Ciba Geigy for fluoroalkyl sodium sulfonate).

The amount of surfactant used can vary over a wide range from about 0.5% to about 10% by weight. The amount of emulsifier will depend on the ability of the emulsifier to stabilize the emulsion.

Any of the free radical initiators used in the prior art may be used in the present invention at an effective concentration, typically at between about 0.3 and about 5% w/w of monomer, a preferred initiator being potassium persulfate, other suitable initiators including azobisisobutyronitrile and similar compounds, and various peroxides. If desired, chain transfer agents can also be employed. Suitable chain transfer agents are well known in the prior art, a preferred agent being dodecyl mercaptan.

While the preferred copolymer system is based on methacrylonitrile/vinyl acetate copolymer, combinations of methacrylonitrile with other comonomers would be expected to function equally well, for example, methacrylonitrile copolymerized with vinyl propionate supplied a copolymer with similar properties.

The principle of regulated inner incompatibility can also be used to enhance nucleation in other polymers which would be suitable as vesicular matrices as long as they are produced by addition polymerization. When one of the monomers will supply a homopolymer of high permeability, its amount in the final polymer must be restricted, in order to not impair the permeability. It is also possible to blend a homopolymer with a copolymer which has as its major component the identical monomer as the homopolymer (the second component of the copolymer being the component which supplies the incompatibility). The resulting blend possesses nucleating properties which are similar to those seen in a copolymer containing the same level of the incompatible comonomer.

The addition of surfactants, particularly fluorosurfactants in small amounts, typically 0.05 to 5 wt. %, and preferably 0.1 to 1.0 wt. % further enhances the speed of the films of the present invention. Though both the inner incompatibility and the surfactant seem to affect primarily the nucleation, the same effect is not produced separately, i.e., with increased incompatibility (higher concentrations of the second monomer or polymer) without surfactant, nor increased surfactant concentration with higher compatibility.

While not wishing to be bound by theory, it is believed that the inner incompatibility produces partial phase separation and voids at the micro-interphase, without which it would be impossible to form vesicles in any system. The surfactant is believed to migrate toward these voids, enlarge them, and decrease the work connected with blowing up the vesicles. With excessive nucleation (higher incompatibility) the number of voids is greater and their volume serves as a pressure sink which reduces the amount of available nitrogen. At the same time, the larger number of vesicles cannot reach a stable size, such that these numerous small vesicles are dissolved in the later phases of the development process. Because of this, it has been determined that an ideal matrix will contain a limited number approximately $10^{12}$ per $cm^3$) of relatively large nucleation centers.

Any of the nonionic, anionic, cationic, or amphoteric surfactants well known for use in this art may be used in preparing a film from the copolymer or blend of polymers and/or copolymers. Particularly good results have been found with various fluorosurfactants. Such surfactants include those sold under the LODYNE trademark by Ciba Geigy including: LODYNE S-107 (fluoroalkyl polyoxyethylene (nonionic)); LODYNE S-103 (fluoroalkyl sodium sulfonate (anionic)); LODYNE S-106 (fluoroalkyl ammonium chloride (cationic)); and LODYNE S-110 (fluoroalkyl amino carboxylic acid and amide (amphoteric)). The best surfactant for any particular copolymer or polymer/copolymer blend can be determined by routine testing, since the surfactant often must be carefully selected to afford a high level of efficiency in a given matrix resin, i.e. they are not always equally applicable over a variety of matrix resins.

In an alternative embodiment of the present invention, it has been found that blends of very incompatible resins will also supply films with excellent resolution. It appears that the resolution is improved by the incompatibility of the two resins, provided the incompatible resin of the smaller amount disperses into particles of an appropriately small size in the resin present in a greater concentration. Incorporation of very small amounts (less than 3 wt. %) of the incompatible resin considerably increases the speed of the films, apparently by enhanced nucleation. However, it has been found and must be emphasized that this small added amount of incompatible polymer does not noticeably affect the mechanical properties of the vesicular film as compared to a film made solely from the polymer present in a larger amount.

This embodiment of the present invention should be distinguished from blending of larger amounts (40–90%) of other resins to improve the mechanical properties of the blend such as that described in U.S. Pat. No. 4,272,603 to Chenevert et al. The system described therein utilizes polymethacrylonitrile of low molecular weight. Incorporation of 40 to 90% of another resin is possible only when polymethacrylonitrile has a very low molecular weight (less than about 10,000). While that patent does not always state the molecular weight of the polymethacrylonitrile used, the molecular weight can be derived from the described properties which were improved with blending. Reference should also be made to column 3, lines 55–61 wherein it is stated that it is preferable to use lower molecular weight polymers of methacrylonitrile because they are compatible with other polymers over a wider range of proportions, and further that particularly useful polymers have a weight average molecular weight of 1440 to 2450.

Typical of the blends which may be utilized in the present invention are blends of polymethacrylonitrile produced by emulsion polymerization using anionic or nonionic emulsifier with small amounts (less than about 3%) of very incompatible resins (e.g., polyvinyl acetate, or vinyl chloride/vinyl acetate copolymer).

The vesiculating agent employed in preparing the vesicular film is sensitive to radiation, e.g., light, so that exposure to the radiation causes decomposition and formation of gas vesicles, preferably of nitrogen. Examples of suitable vesiculating agents include the following:

- p-diazo diphenylamine sulfate;
- p-diazo-dimethylaniline zinc chloride;
- p-diazo-diethylaniline zinc chloride;
- p-diazo-ethyl-hydroxyethylaniline . one-half zinc chloride;
- p-diazo-methyl hydroxyethylaniline . one-half zinc chloride;
- p-diazo-2,5-diethoxy-benzoylaniline . one-half zinc chloride;
- p-diazo-ethyl-benzylaniline . one-half zinc chloride;
- p-diazo-dimethylaniline borofluoride;
- p-diazo-2,5-dibutoxy-benzoylaniline . one-half zinc chloride;
- p-diazo-1-morpholino benzene . one-half zinc chloride;
- p-diazo-2,5-dimethoxy-1-p-toluyl-mercapto benzene . one-half zinc chloride;
- p-diazo-3-ethoxy-diethylaniline . one half zinc chloride;
- p-diazo-2,5-diisopropoxy-1-morpholino benzene sulfosalicylate;
- p-diazo-2,5-diisopropoxy-1-morpholino benzene triflate;
- p-diazo-2,5-diethoxy-1-morpholino benzene sulfosalicylate;
- p-diazo-2,5-diethoxy-1-morpholino benzene triflate;
- 2,5,4'-triethoxy-diphenyl-4-diazonium oxalate;
- p-diazo-diethylaniline . one-half chloride;
- p-diazo-2,5-dibutoxy-1-morpholino-benzene chloride . zinc chloride;
- p-diazo-2,5-dimethoxy-1-morpholino-benzene chloride . zinc chloride;
- p-diazo-2,5-diethoxy-1-morpholino-benzene chloride . one-half zinc chloride;
- 2-diazo-1-naphthol-5-sulfonic acid;
- p-diazo-diethylaniline borofluoride;
- p-diazo-2-chloro-diethylaniline . one-half zinc chloride.

Other suitable light-sensitive, nitrogen-forming compounds are the quinone-diazides, e.g.,

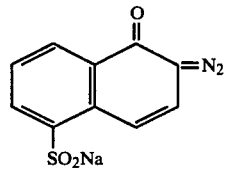

and azide compounds of the type

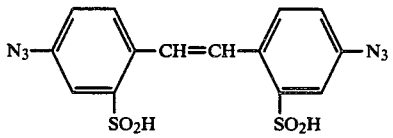

Also the carbazido (carboxylic acid azide) compounds containing a hydroxyl or amino-group in the position ortho to the carbazide group as described in U.S. Pat. No. 3,143,418 would be useful.

It is to be understood that the various physical characteristics of the polymeric materials employed in the present vesicular film system can be varied as desired by the addition of modifiers. Moreover, various materials can be added for the preservation of the sensitizer compound employed, e.g., various acids as taught in the art. Moreover, other materials, such as dyes and other compounds, can be added to improve the photometrics of a particular film without departing from the true scope and spirit of the present invention.

Where a support is employed on which the present vesicular photographic material is overcoated, the support can be any suitable material which is compatible with the medium, e.g. glass, polymeric materials, paper and the like. By compatibility with the photographic medium, it is meant that the support must be free from materials which will degrade the emulsion overlay, e.g.

due to the bleeding of constituents, such as plasticizers, from the polymeric support upon contact with the coating which may contain solvents that would initiate such phenomena. Of course, where the particular physical and/or chemical properties of a support are critical for a given application, this problem may be resolved by treating the support with an intermediate layer or coating which forms a suitable barrier. For photographic applications, a polyethylene terephthalate base material is preferred since it has excellent chemical and physical stability under standard processing conditions and it has excellent dimensional stability. As is well known in the art, where a transparent support is employed a vesicular image recorded thereon in the conventional manner produces a corresponding image having the opposite photographic sign. However, the use of an opaque support, e.g. a black support, will produce a photographic image having the same photographic sign.

The vehicle and the sensitizer may be combined by any suitable method. However, it is preferred that they each be dissolved in a solvent and the resultant solutions combined. In this embodiment it is only necessary that the respective solutions be mutually miscible. For the most part, solvents such as alcohols, ketones, nitriles, esters, ethers and halogenated solvents may be used. Particularly useful are methyl, ethyl and isopropyl alcohols, alkyl acetates, acetone, methyl ethyl ketone, dioxane and acetonitrile. However, any inert solvent which meets the above miscibility requirement may be used.

If a diazo compound is used, as is preferred, it is generally dissolved in a small quantity of a polar solvent such as methanol, aqueous methanol, acetonitrile or acetone, and then added dropwise to the stirred resin solution to minimize precipitation of either the salt or the polymer. The preferred amount of the diazo compound is about 4 to 10 percent by weight of the resin used.

When a diazo compound is used as the vesiculating agent, it is preferred, but not necessary, that the solvent in which the diazo compound is dissolved be compatible with the solvent system selected for the resin in order to minimize the possibility of the diazo compound or the resin precipitating out when the two solutions are mixed. It is understood in the art that a uniform dispersion of the vesiculating agent in the vehicle is desired.

After the film is thus prepared, there are at least three different methods of processing it. In one form, the film is exposed to image forming light, e.g., by being placed in contact with a transparency and exposed to light passing through the transparency, then the film is heated to 160°–500° F., for 1/1000 to 3 seconds. This will produce an image of the opposite photographic sign from the transparency. Thus, if the transparency is negative, a positive vesicular photograph will result.

A second processing system which can be used is that described in U.S. Pat. No. 2,911,299. In it, the film is exposed to image forming light and gas released by the sensitizer is allowed to diffuse from the vehicle at a temperature too low for development to take place. Then the film is exposed overall to uniform light which actuates non-decomposed sensitizer, and it is heated to cause development at 160°–500° F. for 1/1000 to 3 seconds either during or shortly after the second exposure, but before the gas has substantially diffused from the film. This results in image formation in areas not originally struck by light and an image of the same photographic sign as the transparency. Thus, a negative transparency results in the formation of a negative vesicular photograph which might be called a reversal image or a direct image.

The third processing system is that described in U.S. Pat. No. 3,457,071. In that system, the film is exposed to image forming light of relatively low intensity for at least about 0.5 second and preferably for at least about 2.0 seconds. That is, the light is of low enough intensity that the film does not receive a normal exposure in less than 0.5 second and preferably 2.0 seconds. Then the film receives an overall exposure of light intensity which is sufficient to expose the film in less than 0.2 second and preferably less than 0.01 second. Overexposure or longer exposure can be tolerated, but there must be sufficient light to properly expose the film during the indicated time. This procedure avoids a separate diffusion step as used in the method of U.S. Pat. No. 2,911,299. In some cases, no heating is required to cause development, and the image appears spontaneously. However, in other cases, some heating may be used to advantage, as more fully described in U.S. Pat. No. 3,457,071.

In order to further illustrate the present invention and the advantages thereof, the following specific examples are given, it being understood that they are intended only to be illustrative without limiting the scope of the present invention.

EXAMPLE 1

Example 1 represents a typical addition polymerization reaction for producing polymers for use in the present invention.

A 5 l resin kettle is charged with three liters of hot tap water, with dissolved air being removed by applying a vacuum for about five minutes. 30 g of sodium lauryl sulfate is then dissolved under gentle stirring to avoid a vortex which would permit oxygen from the air to redissolve. Next, 1.5 kg of methacrylonitrile which contains 50 ppm of an inhibitor such as hydroquinone monomethylether is added, followed by 10 g (12 ml) of dodecylmercaptan.

This produces a total volume of about 4.9 l. The space above the liquid is flushed with $N_2$ and the flow of $N_2$ is reduced to a low level which will be maintained during the polymerization. The stirrer is started to produce an emulsion and the contents are heated to 65° C.

At this time, 6 g of potassium persulfate dissolved in a small amount of hot water is added. The polymerization will start after an induction period of about 45 minutes, the polymerization rate being practically constant. A 95% conversion is reached in 5 hours, with 99% conversion in 7–8 hours. Typically, the polymerization will be let run overnight to complete the polymerization as much as possible.

The polymerization process can be monitored by the amount of remaining monomer (by gas chromotography) or by dilatometry. A kinetic study by dilatometry determined that 100 g of methacrylonitrile contracts by 43 ml during the polymerization.

The expected $M_v$ of the polymer is about 120,000 and will depend on several factors, mainly on the amount of remaining oxygen and polymerization temperature. The variation of $M_v$ in the range of 60–150,000 does not seem to affect the speed and resolution of final film. However, to keep the rheology of the lacquer constant, it should not vary more than ±10%.

The high amount of emulsifier used in the polymerization lowers the chance of formation of solids. The appropriate level of emulsifier depends on the stirring rate and the shape of the vessel.

After the polymerization is complete, the resin is precipitated from the latex by the addition of a solution of sodium chloride. A fast precipitation invariably results in solidification of the product and should be avoided. Filtration in this state is next to impossible. The recommended way is to dilute the batch to 10 l and warm it up to 70° C. A slow addition of a saturated solution of NaCl (125 ml, while stirring) does not produce any visible solidification and usually results in a filtrable system.

A properly precipitated system should supply a clear filtrate (Whatman #1 filter) from the very beginning. If small latex particles are present, they will gradually plug up the filter. Though a clear filtrate is obtained after a while, filtration may be very slow. In that case another 125 ml of saturated NaCl solution are added and the test repeated after 20 minutes.

Properly precipitated latex not only filters fast but dries faster as well.

The precipitate should then be washed with about 20 l of warm water in several portions.

The polymethacrylonitrile resins used in the remaining examples were prepared in accordance with the procedure of Example 1. $M_v$ values were determined by viscometry in dimethyl formamide.

EXAMPLE 2

Example 2 represents the synthesis of a copolymer for use in the present invention.

To 95 g of methacrylonitrile was added 5 g of vinyl acetate, 350 g of water, 3 g of potassium persulfate, 0.8 g of sodium laurylsulfate, and then 0.25 g of dodecylmercaptan. The space above the liquid in the container was flushed with nitrogen and then the flow of nitrogen was reduced to a low level during the course of the polymerization. The solution was stirred to produce an emulsion and heating was begun to bring the emulsion to 65° C. Polymerization was allowed to continue for 26 hours after which the monomer was stripped from the produced latex by direct steam. The resulting latex was diluted to ½ the concentration and a saturated solution of sodium chloride was added slowly with stirring after allowing the latex to cool to 50° C. This produced a clear filtrate. The precipitate was washed with warm water in several portions.

EXAMPLE 3

The polymer produced in Example 2 was used for a pilot coating trial. The formulation of the lacquer was:

| | Amount (grams) |
|---|---|
| Methacrylonitrile/vinyl acetate copolymer of Example 2 | 2300 |
| Methyl Cellosolve (trademark of Union Carbide for ethylene glycol monomethyl ether) | 920 |
| Methyl ethyl ketone | 8280 |
| Orasol Brilliant Blue G-N (trademark of Ciba Geigy for phthalocyanine dye) | 18.4 |
| Lodyne S-107 (trademark of Ciba Geigy for fluoroalkyl polyoxyethylene) | 5.75 |
| Citric Acid | 142.6 |
| 2,5-diethoxy-4-morpholinobenzene diazonium tetrafluoroborate | 184 |

After mixing, the viscosity of the lacquer was lowered to 250 cps by the addition of 500 ml of methyl ethyl ketone and then laid down on a sheet of polyethylene terephthalate. The resulting film was exposed and developed on a A/M Bruning OP-57 Processer and found to have a resolution of 320 lp/mm and a speed comparable to that of commercially available Xidex SX film.

EXAMPLE 4

A lacquer was prepared from following ingredients:

| | Amount (grams) |
|---|---|
| Polymethacrylonitrile ($M_v$ = 100,000) | 90.25 |
| Polyvinyl acetate ($M_v$ = 15,000) | 0.5 |
| Lodyne S-107 (trademark of Ciba Geigy for fluoroalkyl polyoxyethylene) | 0.25 |
| 2,5-diethoxy-4-morpholinobenzene diazonium tetrafluoroborate | 8.0 |
| Dye used in Example 3 | 1.0 |

A similar lacquer was also prepared in which the polyvinyl acetate was increased to 1.0 g and the polymethacrylonitrile was decreased to 89.75. In comparison testing of films prepared from these lacquers, it was found that the increased amount of polyvinyl acetate resulted in a decrease in speed.

It was also found that substituting a polyvinyl acetate of a higher average molecular weight (100,000) had a deleterious effect on the speed of the film, with a further reduction in speed after a crossover point at about 0.5% by weight.

EXAMPLE 5

Lacquers were prepared using the following ingredients:

| | Amount (grams) |
|---|---|
| Polymethacrylonitrile ($M_v$ = 120,000; 1:1 blend of $M_v$ = 100,000 and $M_v$ = 140,000) | 90.5 |
| Vinyl chloride/vinyl acetate copolymer (see Table I) | 0.25 |
| Lodyne S-107 (trademark of Ciba-Geigy for fluoroalkyl polyoxyethylene) | 0.25 |
| 2,5-diethoxy-4-morpholinobenzene diazonium tetrafluoroborate | 8.0 |
| Dye used in Example 3 | 1.0 |

The results seen when films were prepared from lacquers utilizing the stated copolymers of vinyl acetate and vinyl chloride are set forth below. The speed is set forth against a standard having a speed of 100%.

TABLE I

| Resin* | % Vinyl Chloride | % Vinyl Acetate | Speed |
|---|---|---|---|
| None | — | — | 58 |
| VAGH | 91 | 3** | 80 |
| VAHH | 87 | 13 | 78 |
| VYHD | 86 | 14 | 79 |
| VYNS | 97 | 3 | 83 |
| VMCH | 86 | 13*** | 80 |
| B15 | | 100 | 80 |

*Trademarks of Union Carbide
**6% vinyl alcohol
***1% dibasic acid

As can be seen, all of the copolymers of vinyl acetate and vinyl chloride were approximately equal to polyvinyl acetate alone.

Although the invention has been described in terms of various preferred embodiments, one skilled in the art will appreciate that various modifications, substitutions, omissions, and changes may be made without departing from the spirit thereof. Accordingly, it is intended that the scope of the present invention be limited solely by the scope of the following claims.

What is claimed is:

1. A light sensitive vesicular material comprising a film support and a coating therefor forming a vesicular matrix wherein regulated inner incompatibility supplies domains of incompatibility which serve as nucleation centers, the continuous phase of said coating comprising:

(a) a copolymer of a first monomer of methacrylonitrile and a second monomer of vinyl acetate, prepared by emulsion polymerization using an anionic or non-ionic emulsifier, wherein a homopolymer of said second monomer would be incompatible with a polymer of said first monomer, said copolymer comprising a nucleation enhancing amount which is less than 5% by weight of said second monomer with the remainder of the copolymer being said first monomer which produces a homopolymer of low nitrogen permeability, or (b) a blend of a first polymer or copolymer of methacrylonitrile with a nucleation enhancing amount which is less than 5% by weight of a second polymer or copolymer of vinyl acetate or a vinyl chloride/vinyl acetate copolymer, said first and second polymers or copolymers being incompatible with each other and said first polymer or copolymer having a low nitrogen permeability; and an effective gas-generating amount of a photo-sensitive solid agent substantially uniformly dispersed within said coating, which agent is capable of decomposing to produce nitrogen gas upon exposure to light.

* * * * *